US007845983B2

(12) United States Patent
Kawada et al.

(10) Patent No.: US 7,845,983 B2
(45) Date of Patent: Dec. 7, 2010

(54) CIRCUIT BOARD BUILT-IN CONNECTOR AND CATCHER

(75) Inventors: Kouhei Kawada, Tokyo (JP); Jinsong Wang, Tokyo (JP); Naoki Shibata, Tokyo (JP)

(73) Assignee: Harada Industry Co., Ltd., Tokyo (JP)

( * ) Notice: Subject to any disclaimer, the term of this patent is extended or adjusted under 35 U.S.C. 154(b) by 0 days.

(21) Appl. No.: 12/305,281

(22) PCT Filed: May 10, 2007

(86) PCT No.: PCT/JP2007/000505

§ 371 (c)(1),
(2), (4) Date: Dec. 17, 2008

(87) PCT Pub. No.: WO2008/001482

PCT Pub. Date: Jan. 3, 2008

(65) Prior Publication Data

US 2009/0280688 A1 Nov. 12, 2009

(30) Foreign Application Priority Data

Jun. 28, 2006 (JP) ..... 2006-178647
May 9, 2007 (JP) ..... 2007-124892

(51) Int. Cl.
*H01R 9/03* (2006.01)

(52) U.S. Cl. ..... 439/607.46; 439/607.48; 439/620.08

(58) Field of Classification Search ..... 439/607.46, 439/50, 607.51, 607.08, 607.22, 581
See application file for complete search history.

(56) References Cited

U.S. PATENT DOCUMENTS 4,490,003 A * 12/1984 Robinson ..... 439/325
4,781,623 A * 11/1988 Philippson et al. ..... 439/670
5,757,327 A * 5/1998 Yajima et al. ..... 343/713
5,797,771 A * 8/1998 Garside ..... 439/607.46

(Continued)

FOREIGN PATENT DOCUMENTS

JP 05-191124 7/1993

(Continued)

*Primary Examiner*—T C Patel
*Assistant Examiner*—Harshad C Patel
(74) *Attorney, Agent, or Firm*—Wells St. John P.S.

(57) ABSTRACT

A circuit board built-in connector and a catcher are provided. The circuit board built-in connector and the catcher can be miniaturized, have high cable pulled-out strength and resistance to noise and electrostatic property, and are easy for installation and high in line operability. The circuit board built-in connector for connecting an antenna element (10) with a cable (20) is comprised of a circuit board (1), a ground member (2), and a cable clamping portion (3). The circuit board (1) has connecting terminals and an electronic circuit is placed thereon. The ground member (2) is provided adjacent to a side portion of the circuit board in a perpendicular manner to a plate surface of the circuit board. Then, the cable clamping portion (3) extends from the ground member to hold the cable (20). The catcher (5), on one hand, set on a side of the antenna element, is provided with a ground terminal (50) for connecting the ground member with the ground on the side of the antenna element, and a power supply terminal (51) for connecting a connecting terminal of the circuit board with the antenna element.

16 Claims, 7 Drawing Sheets

U.S. PATENT DOCUMENTS

| | | | | |
|---|---|---|---|---|
| 6,310,586 | B1 * | 10/2001 | Takahashi et al. | 343/872 |
| 7,037,144 | B2 * | 5/2006 | Wang et al. | 439/736 |
| 7,210,965 | B1 * | 5/2007 | Zhong et a | 439/607.01 |
| 2001/0022716 | A1 * | 9/2001 | Glaser et al. | 361/117 |
| 2009/0156059 | A1 * | 6/2009 | Zhu et al. | 439/607.41 |

FOREIGN PATENT DOCUMENTS

| | | | |
|---|---|---|---|
| JP | 06-203897 | | 7/1994 |
| JP | 2000-353573 | | * 12/2000 |
| JP | 2001-291540 | A | 10/2001 |
| JP | 2003-264043 | A | 9/2003 |
| JP | 2004-031068 | A | 1/2004 |
| JP | 2005-110200 | A | 4/2005 |
| JP | 2006-059646 | A | 3/2006 |

* cited by examiner

CIRCUIT BOARD BUILT-IN CONNECTOR AND CATCHER

CROSS REFERENCE TO RELATED APPLICATION

This is a 35 U.S.C. §371 application of and claims priority to International Application No. PCT/JP2007/000505, which was filed on May 10, 2007, and which claims priority to Japanese Patent Application No. 2006-178647, which was filed on Jun. 28, 2006, and Japanese Patent Application No. 2007-124892, which was filed on May 9, 2007, and the teachings of all the applications are incorporated herein by reference.

TECHNICAL FIELD

The present invention relates to a circuit board built-in connector and a catcher for connecting an antenna element and a cable, and more particularly to a circuit board built-in connector and a catcher having a ground member for ensuring the ground of a circuit board.

BACKGROUND ART

An antenna provided on a glass of a vehicle window is roughly divided into two types: a glass antenna and a film antenna. The glass antenna is provided by previously burying an antenna element in a glass plate. The film antenna is provided by adhesively attaching an antenna element on a glass plate. Both antennas typically have a configuration in which a power supply terminal and a ground terminal are provided on the antenna element side and these terminals and a cable extending from an external communication device such as a tuner are connected to each other via a connector.

In recent years, along with the spread of terrestrial digital broadcasting, a terrestrial digital TV tuner has come to be mounted on a vehicle such a car. It is necessary to provide an amplifier circuit just near an antenna pattern in the case of an antenna for terrestrial digital TV broadcasting in view of inherent characteristics thereof. Therefore, there has been proposed a configuration in which a connector for connecting an antenna element and an external communication device is provided just near the antenna element and an amplifier circuit is incorporated in the connector. For example, such a connector incorporating the circuit board is disclosed in Patent Document 1 for glass antenna and Patent Document 2 for film antenna.

Patent Document 1: Japanese Patent Application Kokai Publication No. Hei 5-191124

Patent Document 2: Japanese Patent Application Kokai Publication No. 2005-110200

DISCLOSURE OF THE INVENTION

Problems to be Solved by the Invention

In the case where a connector for connecting an antenna element and an external communication device such as a tuner is provided just near an antenna element, the size of the connector needs to be reduced as much as possible for space. Also, in order to prevent a cable being pulled out, the connector needs to have a certain mechanical strength. Further, in the case of the antenna for terrestrial digital TV broadcasting, when an amplifier circuit is housed in the connector provided just near the antenna element, the amplifier circuit is greatly influenced by external noise such as an electric field or electromagnetic wave. Further, although all over ground pattern circuit board is desirable for ensuring a large ground of the circuit board at a high-frequency region, there is a limit to the size of the ground, so that it is impossible to enhance receiving stability. Such problems are experience in conventional connectors incorporating the circuit board, including those disclosed in Patent Document 1 and Patent Document 2. That is, the conventional connectors have a large size; they do not have a sufficient mechanical strength for preventing a cable being pulled out; they are susceptible to external noise such as electromagnetic noise or electrostatic noise; and they do not have high receiving stability. Thus, development of a circuit board built-in connector capable of reducing the size, having a sufficient mechanical strength for preventing a cable being pulled out, and exhibiting high resistance to noise and high receiving stability is demanded.

The present invention has been made in view of the above situation, and an object thereof is to provide a circuit board built-in connector and a catcher capable of reducing the size thereof, having a sufficient mechanical strength for preventing a cable being pulled out, exhibiting high resistance to noise or static electricity, exhibiting high receiving stability, and achieving easy installation structure for higher efficiency of production line work.

Means for Solving the Problems

To achieve the above object, according to the present invention, there is provided a circuit board built-in connector for connecting an antenna element and a cable. The connector comprises: a circuit board which has a connection terminal and on which an electrical circuit placed; a ground member provided adjacent to a side portion of the circuit board in a perpendicular manner to a plate surface of the circuit board; and a cable clamping portion extending from the ground member and holding the cable.

The ground member and the cable clamping portion may integrally be molded.

The ground member may be provided at both longitudinal side portions of the circuit board.

The ground member may have a U-shape cross-section as viewed from the narrow side and surround the circuit board from at least three directions.

The circuit board built-in connector may further comprise an insulating cover for insulating the ground member and the cable clamping portion from outside.

The circuit board built-in connector may further include a constricted portion positioned between the ground member and the cable clamping portion, and the insulation cover may have a convex portion engaged with the constricted portion.

The insulating cover may have knobs for removal.

The connection terminal of the circuit board may be a surface-mounting connection terminal.

The cable clamping portion may include a cable fixing portion and an electrical connection portion.

A portion between the ground member and the cable clamping portion may be formed to have a curved surface through a drawing process.

The circuit board may be formed by resin molding.

The circuit board built-in connector may further comprises a surge protecting element which is provided adjacent to the connection terminal of the circuit board. The ground member may be positioned away from the connection terminal of the circuit board to such a degree that the ground member and the connection terminal are not capacity-coupled and extend adjacent to the surge protection element.

Further, according to the present invention, there is provided a catcher provided on an antenna element side to which the circuit board built-in connector having the above configuration is fitted. The catcher may comprise: a ground terminal for connecting the ground member and a ground on the antenna element side; and a power supply element for connecting the connection terminal of the circuit board and the antenna element.

The catcher may further comprise an insulating side wall for insulating a connection portion between the ground member and the ground terminal from outside.

The catcher may further comprise an insulating cover for insulating the ground member and the cable clamping portion from outside.

ADVANTAGES OF THE INVENTION

The circuit board built-in connector and the catcher according to the present invention is capable of reducing the size thereof and having a sufficient mechanical strength for preventing a cable being pulled out and, therefore, can conform to various specifications. By providing the large-sized ground member outside the circuit board, the operating stability of an amplifier circuit and the like placed on the circuit board can be increased. By providing the ground member in such a manner as to surround the circuit board, the ground member serves not only as a ground but also as an electromagnetic shield, thereby improving signal receiving stability during vehicle driving time. Further, since the metal terminal or the ground member is not exposed outside, resistance to static electricity is high, thereby preventing an incorporated electrical circuit from being unexpectedly damaged by static electricity. Further, since an installation work is easy, higher efficiency of production line work can be achieved. Further, the circuit board built-in connector on the cable side can continuously be used even when the antenna element is replaced by a new one, so that an eco-friendly connector and a catcher can be provided.

BEST MODE FOR CARRYING OUT THE INVENTION

Preferred embodiments for carrying out the present invention will be described below with reference to the accompanying drawings. FIG. 1 is an exploded perspective view for explaining a configuration of a first embodiment of a circuit board built-in connector and a catcher according to the present invention. The circuit board built-in connector and the catcher according to the present invention are used for connecting an antenna element 10 and a cable 20. The antenna element 10 is intended to be used mainly as a glass antenna and a film antenna to be mounted on a vehicle in this specification. However, the antenna used in the present invention is not especially limited to the glass antenna and film antenna, but any type of antenna may be used as long as a connector and a catcher are employed for providing an amplifier circuit adjacent to the antenna element.

The connector according to the present invention shown in FIG. 1 is mainly constituted by a circuit board 1, a ground member 2, a cable clamping portion 3 and an insulating cover 4, and is fitted to a catcher 5. A predetermined electrical circuit 11 such as an amplifier circuit and a filter circuit is placed on the circuit board 1. In addition, the circuit board 1 has a connection terminal for connection to a cable core, an antenna element or a ground. More specifically, a connection terminal 12 shown in FIG. 1 is constituted by a land to which the core wire of the cable 20 can be soldered, and a connection terminal 13 is constituted by a terminal receiving portion for holding a power supply terminal 51 (to be described later) provided on the catcher 5. The circuit board 1 may be a one-side circuit board or two-side-circuit board.

The circuit board 1 is received inside a ground member 2. The ground member 2 serves as the ground of the circuit board 1. As illustrated, the ground member 2 has a U-shape cross-section as viewed from the narrow side and surrounds the circuit board 1 from three directions corresponding to the longitudinal direction thereof. The ground member 2 having the configuration that surrounds the circuit board 1 in the manner as described above not only serves as a large-sized ground for the circuit board 1 but also serves as an electrostatic shield and an electromagnetic shield. When obtaining the configuration that surrounds the circuit board 1 from three directions, a conductive flat plate is subjected to a cutting/punching work and, after that, subjected to a bending work, whereby the ground member having the U-shaped cross-section can easily be produced.

Fixing claws 21 may be formed on the ground member 2 so that the circuit board 1 can be fitted and fixed in the ground member 2. By soldering connection terminals of the circuit board 1 to the fixing claws 21 of the ground member 2, the ground member 2 serves both as the ground of the circuit board and fixing member for the circuit board. Concave portions 22 with which a ground terminal 50 (to be described later) on the antenna element side are engaged are formed at the center portions of both side surfaces of the ground member 2. Although the concave portions 22 are formed on the center portions of the side surfaces of the ground member 2 in the illustration, the concave portions 22 may be formed on any part of the ground member 2 as long as they can be engaged with the ground terminal 50. Further, an opening 23 for terminal is formed on the ground member 2 so that a connection terminal of the circuit board (to be more precise, an input terminal 13 of an electrical circuit such as an amplifier circuit) can be connected to an exterior of the connector through the opening 23.

The circuit board 1 may completely be resin-molded by using mold resin such as polyamide or polyolefin. In this case, the molding may not only be carried out for only the circuit board 1 but also be carried out in such a manner as to cover the entire internal part of the ground member 2 including the circuit board 1. By applying resin-molding, it is possible to enhance insulating performance and waterproof performance of the circuit board 1 and to increase the mechanical strength for preventing the cable 20 being pulled out.

The cable clamping portion 3 extending from the ground member 2 for holding the cable 20 is further provided to the ground member 2. The cable clamping portion 3 holds the cable 20, and by clamping the cable 20 with the cable clamping portion 3, it is possible to rigidly hold the cable 20 to thereby prevent the cable 20 being pulled out. The configuration in which the ground line of the cable 20 is clamped by the cable clamping portion 3 allows the cable 20, ground member 2, and circuit board 1 to be grounded. The cable clamping portion 3 of this example is integrally formed with the ground member 2 through a cutting/punching work and a bending work applied to a conductive plate in this example. However, the present invention is not limited to this, but the cable clamping portion 3 may be soldered or bolted to the ground member 2. That is, the cable clamping portion 3 may be configured so as not to be separated from the ground member 2 and electrical conductivity may be established between the cable clamping portion 3 and the ground member 2. By integrally forming the cable clamping portion 3 and the ground member 2, it is possible not only to increase the mechanical strength for preventing a cable being pulled out but also to receive the core wire of the cable 20 inside the ground member 2, whereby the shield effect of the ground member are also provided on the core wire.

As described above, the ground member 2 serves not only as the ground of the circuit board but also as the shield for the electrical circuit, the fixing of the circuit substrate, the fixing of the cable, and the shield of the core wire of the cable. Therefore, it is possible to reduce the entire size of the connector although the ground member is newly added as a component of the connector. Although the cable clamping portion 3 extends from the end of the bottom portion of the ground member 2 in this example, it may be so formed as to extend from the end of the side surface of the ground member 2 depending on the arrangement of the connector. Further, the ground member 2 and the cable clamping portion 3 are positioned at the same height level in this example. However, the present invention is not limited to this, and the cable clamping portion 3 may be bent upward to be positioned different in height level for the ground member 2.

Although the ground member used in the present invention has a U-shape cross-section as viewed from the narrow side and surrounds the circuit board 1 from three directions corresponding to the longitudinal direction thereof, the configuration of the ground member of the present invention is not limited to this. FIGS. 2A and 2B show other examples of the configuration of the ground member. In FIGS. 2A and 2B, the same reference numerals as those in FIG. 1 denote the same parts, and the overlapped descriptions will be omitted. As shown in FIG. 2A, one ground member 2' may be provided on one side of the circuit board 1 to be a T-shape cross-section as viewed from the narrow sides of the circuit board and the ground member. Further, as shown in FIG. 2B, two ground members 2' may be provided on each side of the circuit substrate 1 to be an H-shape cross-section as viewed from the narrow sides of the circuit board and the ground member. In order to realize a large-sized ground, it is preferable that the side surface on which the ground member 2' is provided be the longitudinal side of the circuit board 1. Further, the ground member used in the present invention may be configured to surround substantially the entire circuit board 1 from, e.g., four to six directions.

As described above, the ground member used in the present invention may have any configuration as long as it is provided adjacent to the side portion of the circuit board in a perpendicular manner to the board surface thereof to serve as a large-sized ground for the circuit board. The term "perpendicular" used in the present specification does not strictly mean the exact perpendicular. That is, the ground member need not be provided strictly at 90 degrees with respect to the circuit board but may be provided at any suitable angle with respect to the circuit board depending on the shape and the like thereof. Further, it is not necessarily the case that the ground member is formed into a flat surface, and the ground member may be formed into, e.g., a curved surface.

A surge protective device is typically provided on the circuit board 1 in order to protect an integrated circuit on the circuit board 1 against static electricity. In general, the surge protective device is provided adjacent to the external terminal on the circuit board 1 and is grounded to the ground area on the circuit board. When an overcurrent is applied to the circuit, the surge protective device allows the overcurrent to escape not to the circuit side but to the ground side to thereby protect the circuit elements. In the case where it is necessary to reduce the size of the circuit board as much as possible, as in the case of the circuit board built-in connector according to the present invention, there is insufficient free space on the circuit board, so that it is impossible to provide a sufficient ground area. This makes a path for connecting the surge protection circuit and the ground narrow. Thus, there is a possibility that ground impedance increases so that discharge to the circuit side where impedance is low occurs. In the present invention, in order to solve this problem, the surge protective device is provided adjacent to the connection terminal 13 of the circuit board 1 and the ground member 2. By providing the surge protective device adjacent to the ground member 2 which is a large ground area, it is possible to reduce ground impedance to a lower level to thereby enhance surge protection performance on the circuit side.

As the size of the circuit board is reduced, the connection terminal (Hot terminal) and the ground member may be capacity-coupled to each other in the case where the entire board is covered by the ground member. In this case, the ground member on the connection terminal side may be shortened such that the entire circuit board is not covered by the ground member and that the ground member is positioned away from the connection terminal to such a degree that the ground member and the connection terminal are not capacity-coupled. However, in the case where the surge protective device is used as described above, if the connection terminal and the ground member are away from each other, the surge protective device and the connection terminal/ground member are also away from each other, so that ground impedance may increase. FIG. 3 is a perspective view for explaining a configuration example of the ground member for solving the above problem. As illustrated, the ground member 2 extends adjacent to the surge protective device 18 such that the surge protective device 18 and the ground member 2 are close to each other while the connection terminal 13 and the ground member 2 are away from each other. More specifically, the connection terminal 13 is surface-mounted on the back surface of the circuit board 1, a land to be electrically connected to the connection terminal 13 via a through-hole is provided, the surge protective device 18 is provided between the land and the ground member 2, and the ground member 2 is configured so as to extend adjacent to the surge protective device 18, but so as not to cover the connection terminal 13. This configuration prevents capacity coupling as well as enhances surge protection performance.

The insulating cover 4 is for housing the ground member 2 and the cable clamping portion 3 having the configurations described above. The insulating cover 4 covers the ground member 2 and the cable coupling portion 3 so that they are not exposed outside. The electrical circuit placed on the circuit board 1 is often susceptible to static electricity and, even if the circuit board 1 is only slightly exposed outside, there is a possibility that the electrical circuit is damaged by static electricity at the time of connection between the cable and the antenna element. Thus, the insulating cover 4 is configured to cover both the ground member 2 that receives the circuit board 1 and the cable clamping portion 3 that holds the cable 20. In this illustrated example of the connector, cut portions 40 are formed so that the ground terminal 50 (to be described later) on the antenna element side can be engaged with the concave portions 22 of the ground member 2. Further, engaging projections 41 may be formed on the insulating cover 4 so that the engaging projections 41 latch to the catcher 5 (to be described later).

Knobs for removal may be provided on the insulating cover 4. For example, in case of connector failure, the connector needs to be removed from the catcher. In this case, if the knobs for removal are provided on the insulating cover, the connector can easily be removed. FIGS. 4A and 4B are perspective views for explaining configuration examples in which the knobs for removal are provided on the insulating cover. FIG. 4A shows an example of projecting knobs, and FIG. 4B shows an example of elastic knobs. As shown in FIG. 4A, the insulating cover 4 has knobs 45*a* and 45*b* for removal projecting in the horizontal direction from both sides of the portion that covers the cable clamping portion 3. Further, there may be provided knobs 45*c* and 45*d* for removal projecting in the horizontal direction from both longitudinal sides of the portion that covers the ground member 2. Further, as shown in FIG. 4B, there may be formed knobs 46*a* and 46*b* for removal each extending from the insulating cover 4. Each of the knobs 46*a* and 46*b* has cut portions on both sides of the engaging projection 41 so as to have elasticity. When the knobs 46*a* and 46*b* for removal are pinched, they are bent inward to be released from engaging grooves 56 (to be described later), making it easy to remove the connector from the catcher. Further, there may be formed knobs 46*c* and 46*d* for removal having the same configuration on both sides of the portion that covers the cable clamping portion 3. The above-mentioned knobs 45*a*, 45*b*, 45*c*, and 45*d* for removal and knobs 46*a*, 46*b*, 46*c*, and 46*d* for removal may be combined appropriately. In the case where the knobs for removal are provided on the portion that covers the cable clamping portion 3, the connector size is not increased because, in the connector of the present invention, this portion is a space that does not interfere with the circuit board 1 and the ground member 2 housed in the insulating cover 4.

FIG. 5 is a perspective view showing a state where the ground member 2 and the cable clamping portion 3 are housed in the insulating cover 4, as viewed from the back surface side. In FIG. 5, the same reference numerals as those in FIG. 1 denote the same parts, and the overlapped descriptions will be omitted. As illustrated, a constricted portion 24 is formed between the ground member 2 and the cable clamping portion 3, and a convex portion 42 engaged with the constricted portion 24 is formed on the insulating cover 4. This configuration prevents the insulating cover 4 from easily being separated from the ground member 2 and the cable clamping portion 3.

Referring back to FIG. 1, the catcher 5 is provided on the antenna element 10 side. The catcher 5 has a ground terminal 50 for grounding the ground member 2 and a power supply terminal 51 for connecting a connection terminal of the circuit board, e.g., an input terminal 13 of an electrical circuit such as an amplifier circuit to the antenna element 10. In the example of FIG. 1, the catcher 5 has a configuration for a glass antenna and is electrically connected respectively to a ground side fixed terminal 52 and a power supply side fixed terminal 53 to be soldered to a ground terminal and a power supply terminal of the glass antenna.

The connector and the catcher according to the present invention is not limited for those used in the glass antenna but may be used for a film antenna. In this case, it is only necessary to change the terminals to those for the film antenna.

The ground terminal 50 is engaged with the concave portions 22 of the ground member 2 via the cut portions 40 of the insulating cover 4 for electrical connection. Further, the ground terminal 50 is flexible enough to hold the ground member 2. The power supply terminal 51 is electrically connected to the connection terminal 13 of the circuit board 1 via the opening 23 of the ground member 2. Further, the catcher 5 of this example has an insulating side wall 54 that surrounds the side surfaces of the insulating cover 4, thereby preventing a connection portion between the ground member 2 and the ground terminal 50 from being exposed outside. The side wall 54 has a cut portion 55 for arranging the portion of the insulating cover 4 that covers the cable clamping portion 3 outside the catcher 5. The side wall 54 of this illustrated example has the cut portion 55. However, the present invention is not limited to this, but the cut portion 55 may be omitted from the structure. In this case, the catcher 5 may be configured to house the entire insulating cover 4. Further, the side wall 54 may have engaging grooves 56 to be engaged with the engaging projections 41 on the insulating cover 4.

Further, the side wall 54 is so formed as to have an opening at the upper portion in the catcher 5 of this illustrated example and the connector is fitted through the opening from above. However, the present invention is not limited to this, but the opening may be formed on the longitudinal or transverse side portion of the catcher 5 for receiving the connector from the side. In this case, a configuration may be employed in which the insulating cover for insulating the ground member and the cable clamping portion from outside is omitted and the insulating function thereof is provided to the catcher. That is, the catcher is so configured as to surround the entire structure including the ground member and the cable clamping portion so that they can be insulated from outside. Alternatively, a configuration may be employed in which a part of the structure including the ground member and the cable clamping portion is insulated by the insulating cover and the remaining part thereof is insulated by the catcher.

In the case where the circuit board built-in connector and the catcher according to the present invention are used for a glass antenna for a vehicle, a rear glass or the like having a glass antenna that antenna element has been soldered to the catcher 5 is prepared. Meanwhile, the connector constituted by the circuit board 1, the ground member 2, the cable clamping portion 3 and the insulating cover 4 is connected to the end of the cable 20. Then, in the product assembly process, simply by engaging the connector and the catcher with each other, electrical connection and fixation can easily be achieved. In the case where the circuit board built-in connector and the catcher according to the present invention are used for a film antenna for a vehicle, a double-sided adhesive tape is attached to the bottom surface of the catcher 5 on the antenna element side, a film antenna is adhered to a glass surface, the catcher 5 is fixed to a predetermined position of the film antenna using the double-sided adhesive tape, and the connector of the present invention connected to the end of the cable 20 is fitted to the catcher 5, whereby electrical connection and fixation can easily be achieved.

A second embodiment of the circuit board built-in connector and the catcher according to the present invention will be described with reference to FIG. 6. In FIG. 6, the same reference numerals as those in FIG. 1 denote the same parts, and the overlapped descriptions will be omitted. FIG. 6 is a longitudinal cross-sectional view for explaining a configuration of the second embodiment of the circuit board built-in connector and the catcher according to the present invention. In this example, the ground member 2 has a U-shape cross-section as viewed from the narrow side as in the case of the ground member 2 of FIG. 1.

There may be a case where electrical components having a large dimension in the height direction are placed on the circuit board 1. In this case, an additional installation space needs to be ensured. Further, in the case where a distance is small between the female type connection terminal 13 having a terminal receiving portion provided on the circuit board 1 and the needle-shaped power supply terminal 51 provided on the catcher 5 is, it may be difficult to insert the power supply terminal into the terminal receiving portion. In view of this, in the second embodiment, an insulating spacer 6 is provided between the circuit board 1 and the ground member 2 in order to ensure a clearance between the circuit board 1 and the ground member 2. This allows the installation position of the circuit substrate 1 to be raised relative to the bottom surface of the ground member 2. As a result, a space is made between the back surface of the circuit board 1 and the ground member 2, thereby allowing installation of a tall circuit element 14. Further, the power supply terminal can easily be inserted into the terminal receiving portion, thereby making it easy to fit the connector and the catcher to each other.

In the case where the installation position of the circuit board 1 is raised, a displacement may occur in the height direction between the cable 20 and circuit board 1. This makes it difficult to solder the core wire of the cable 20 to the land of the connection terminal 12 of the circuit board. To cope with this problem, a cable-bending guide portion 60 for bending the cable end in a predetermined direction is provided on the insulating spacer 6. Here, with reference to FIG. 7, the insulating spacer 6 and the cable-bending guide portion 60 will be described in more detail. FIG. 7 is a perspective view showing the insulating spacer 6 used in the connector according to the present invention. The cable-bending guide portion 60 is provided at the end portion of the insulating spacer 6 as illustrated. In this example, the cable-bending guide portion 60 is constituted by a concave portion projecting in the vertical direction. The end portion of the cable extending in the longitudinal direction is held in the concave portion and bent in the vertical direction therealong. As a result, the cable end can be guided to the connection terminal 12 of the circuit board at the same time when the cable 20 is clamped in the cable clamping portion 3, thereby increasing the efficiency of a wiring work. In this case, in order to easily position the core wire of the end of the cable bent by the cable-bending guide portion 60 to the connection terminal 12 of the circuit board 1, a cut portion 15 as shown in FIG. 6 may be formed on the circuit board 1. By receiving the core wire of the cable 20 in the cut portion 15, it is possible to adjust the position of the core wire at the same time when the cable 20 is clamped in the cable clamping portion 3, thereby further increasing working efficiency. The cable end is bent in the vertical direction in this illustrated example. However, the present invention is not limited to this, but the cable end may be bent in an arbitrary direction or at an arbitrary angle. For example, the cable end may be bent in the direction toward a predetermined connection terminal of the circuit board or may be bent so as to bypass a predetermined location, which is required for restriction on the installation space.

At the end portion of the insulating spacer 6 on the opposite side to the end portion at which the cable-bending guide portion 60 is provided, a receiving portion spacer 61 for ensuring a clearance for the terminal receiving portion of the circuit board 1 is provided. In the illustrated example, the receiving portion spacer 61 is so formed into a square-shape as to cover the terminal receiving portion. However, the receiving portion spacer 61 may be formed into any shape, such as column shape or convex shape, as long as a space for the terminal receiving portion can be ensured.

A third embodiment of the circuit board built-in connector and the catcher according to the present invention will be described with reference to FIG. 8. In FIG. 8, the same reference numerals as those in FIG. 1 denote the same or corresponding parts, and the overlapped descriptions will be omitted. FIG. 8 is an exploded perspective view for explaining a configuration of the third embodiment of the circuit board built-in connector and the catcher according to the present invention. The third embodiment differs from the first embodiment shown in FIG. 1 mainly in the configurations of the insulating cover 4' and the catcher 5'. The insulating cover 4' of the third embodiment does not have the cut portion as shown in FIG. 1 and is configured to cover the entire side wall of the ground member 2. With this configuration, when the ground member 2 is fitted to the insulating cover 4', the ground terminal 50' provided on the catcher 5' is fitted to a space created between the concave portion 22 of the ground member 2 and the insulating cover 4'. Since it is possible to prevent a connection portion between the ground member 2 and the ground terminal 50' from being exposed outside by the insulating cover 4', there is no need to increase the height of the side wall of the catcher 5' up to the level of the side wall of the catcher 5 like in the first embodiment. Therefore, the projection of the catcher can be reduced to a lower level.

Although FIG. 1 shows the connector and the catcher for a glass antenna, FIG. 8 shows those for a film antenna. That is, in this example, an opening 57 positioned on the land of the antenna element 10 of the power supply terminal side is formed on the catcher 5', and the connection terminal 13' provided on the circuit board 1 is constituted by a contact terminal having elasticity. This connection terminal 13' is electrically connected to the land of the power supply terminal via the opening 57. However, the present invention is not limited to this, but the connector and the catcher according to the third embodiment may be applied to a glass antenna. Further, the circuit board built-in connector according to the present invention may have a configuration in which the connector is attached, not via the catcher 5' of FIG. 8, but directly to the antenna element 10 using, e.g., a double-sided adhesive tape. That is, a part of the ground member 2 corresponding to the position of the land of the antenna element 10 may have a terminal structure to be directly electrically connected to the land and, in this case, the catcher to be fitted to the connector is not used, but a double-sided adhesive tape or the like is used to directly attach the connector to a glass or film.

Next, a modification of the connection terminal of the circuit board 1 of the circuit board built-in connector according to the present invention will be described with reference to FIG. 9. FIG. 9 is a partly exploded perspective view for explaining a modification of the connection terminal of the circuit board built-in connector according to the present invention. In FIG. 9, the same reference numerals as those in FIG. 1 and FIG. 8 denote the same or corresponding parts, and the overlapped descriptions will be omitted. Although the illustrated catcher 5' does not have the side wall like in FIG. 8, the present invention is not limited to this.

In FIG. 1, a configuration example in which the needle-shaped power supply terminal 51 provided on the catcher 5 side is inserted into and held by the female type connection terminal 13 of the circuit board 1 is shown. However, in the example of FIG. 9, the connection terminal of the circuit board 1 is constituted by a surface-mounting type connection terminal 13', and the power supply terminal of the catcher 5' is constituted by a female type power supply terminal 51' having enough flexibility to receive and hold the surface-mounting type connection terminal 13'. Openings 23' for terminal via which the surface-mounting type connection terminal 13' is held by the power supply terminal 51' is formed at a predetermined position in the ground member 2.

The use of the surface-mounting type connection terminal 13' allows an electrical circuit to be mounted also on the surface of the circuit board 1 opposite to the surface having the connection terminal, which enables a larger-scale circuit to be incorporated in the connector. Further, since the needle-shaped terminal is not used, it is possible to avoid a risk that the terminal is accidentally bent at the time when the connector and the catcher are fitted to each other. Further, the connection area between terminals is increased, so that high connection reliability is realized. The opening 23' for terminal may be provided at two locations in the example of FIG. 9. However, the present invention is not limited to this, but the opening 23' for terminal may have any configuration as long as the power supply terminal 51' and the ground member 2 are not short-circuited.

Next, a modification of the cable clamping portion 3 of the circuit board built-in connector according to the present invention will be described with reference to FIG. 10. FIG. 10 is a perspective view for explaining a modification of the cable clamping portion of the circuit board built-in connector according to the present invention. In FIG. 10, the same reference numerals as those in FIG. 1 and FIG. 8 denote the same or corresponding parts, and the overlapped descriptions will be omitted. In general, when the cable is inserted in the cable clamping portion, braided wires of a coaxial cable are exposed and folded back. At this time, unevenness may occur in the density of the braided wires, causing the impedance to be shifted from 75Ω. In order to cope with this problem, in the modification shown in FIG. 10, the cable clamping portion is constituted by a cable fixing/clamping portion 31 for cable fixation and an electrical connection clamping portion 32 for electrical connection. As to the coaxial cable, the insulating sheath of the coaxial cable is peeled off, and an external conductor is widely exposed with the braided wires not being folded back. Then, the exposed braided wire portion is clamped by the electrical connection clamping portion 32 and the insulating sheath portion is clamped by the cable fixing/clamping portion 31. As a result, it is possible to achieve reliable electrical connection and to prevent the cable being pulled out.

Further, in order to increase the mechanical strength and durability of a bridge portion between the cable clamping portion 3 and the ground member 2, the bridge portion may be formed to have a curved surface as shown in FIG. 10 through a drawing process (drawing press). This increases the mechanical strength as compared to a plain plate surface, resulting in an increase in resistance to bending stress or tension stress. Further, the width of the bridge portion on the ground member side 2 may be increased and tapered toward the cable clamping portion 3. Also in this case, the mechanical strength can be increased. Further, the increase of the width of the bridge portion between the ground member 2 and the cable clamping portion 3 leads to an improvement in shielding performance of the cable core wire. Further, by raising up both sides of the bridge portion between the ground member 2 and the cable clamping portion 3 to such a degree as to surround the cable core wire through a drawing process, etc., the shield performance can further be increased. Further, the illustrated cable clamping portion 3 of this example is raised up from the bottom surface of the ground member 2 in the height direction. This makes the heights of the cable core wire and the connection land of the circuit board equal, making it easy to carry out a cable soldering work.

The circuit board built-in connector and the catcher according to the present invention are not limited to the examples shown in the accompanying drawings but can be variously modified without departing from the spirit and scope of the invention.

EXPLANATION OF REFERENCE SYMBOLS

Figure 1:
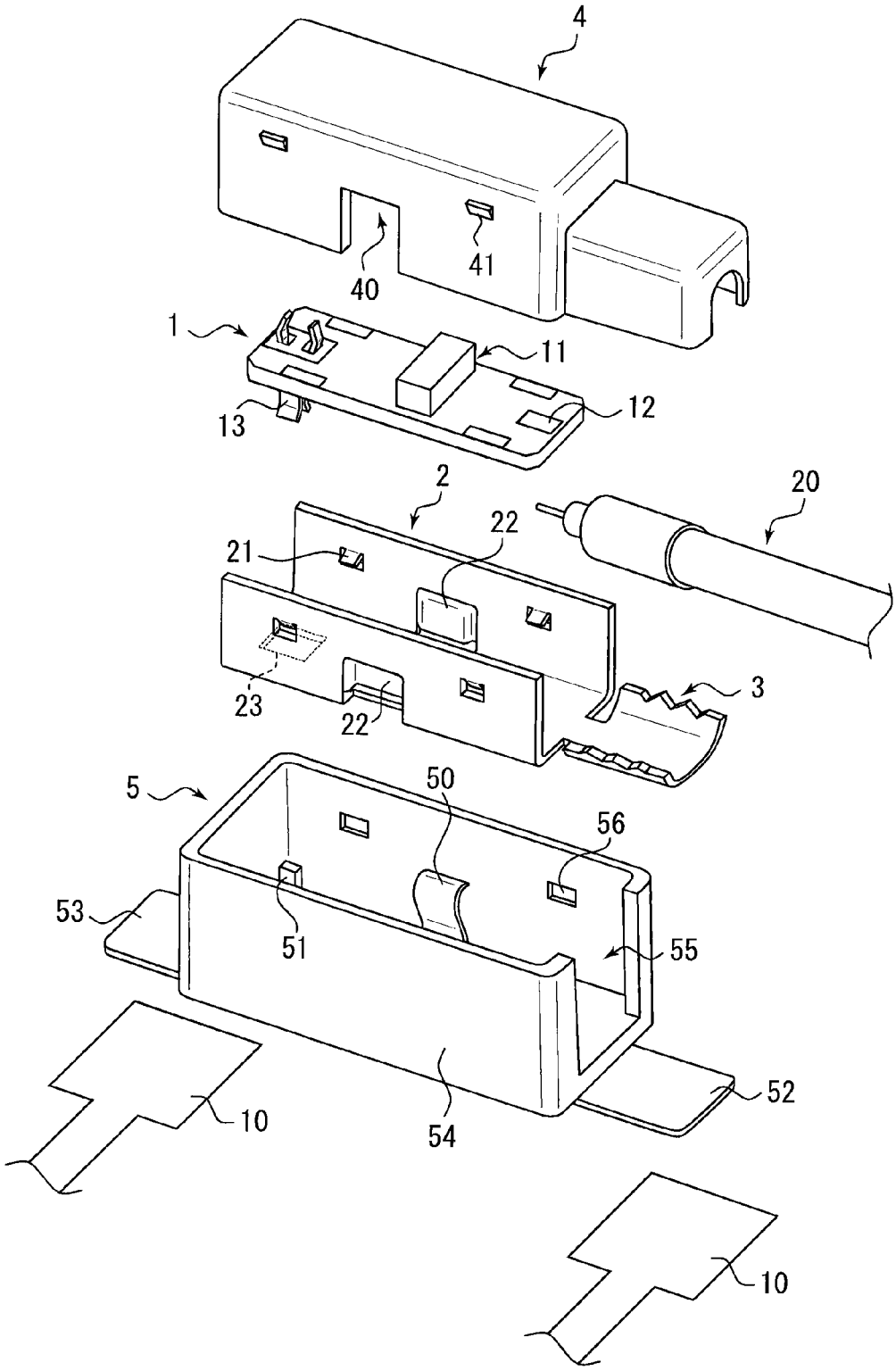
FIG. 1 is an exploded perspective view for explaining a configuration of a first embodiment of a circuit board built-in connector and a catcher according to the present invention.
Figure 2A:
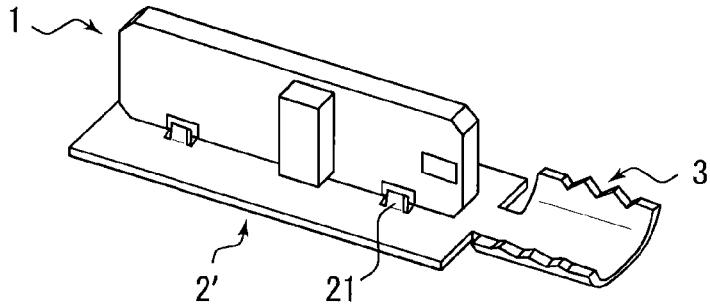
FIGS. 2A and 2B are perspective views for explaining other examples of a ground member of the circuit board built-in connector according to the present invention.
Figure 2B:
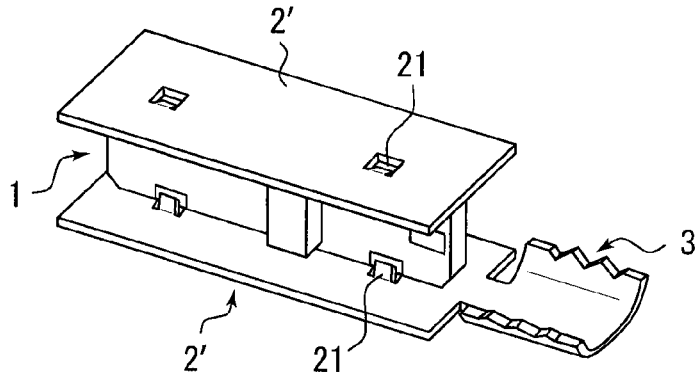
Figure 3:
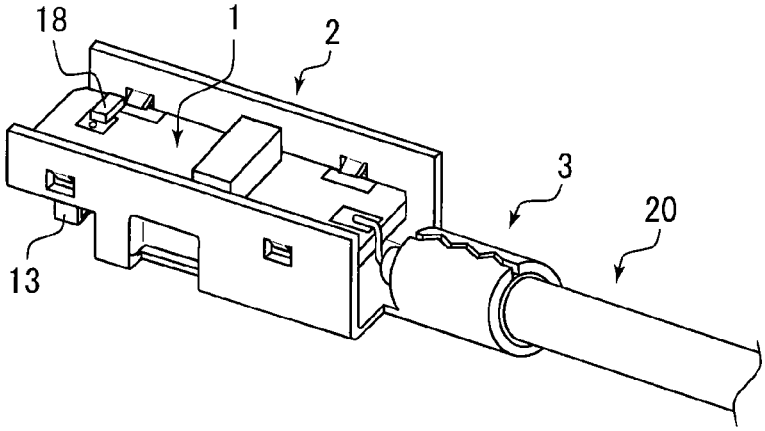
FIG. 3 is a perspective view for explaining a configuration example of the ground member.
Figure 4A:
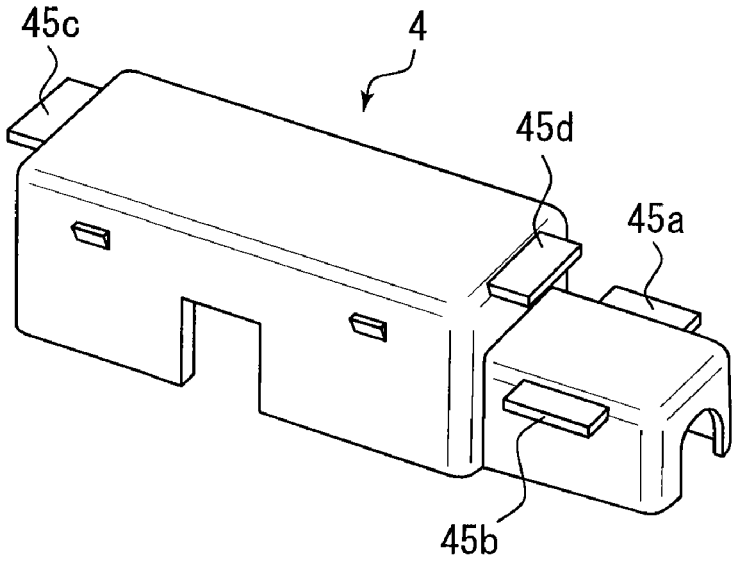
FIGS. 4A and 4B are perspective views for explaining configuration examples in which knobs for removal are provided on an insulating cover.
Figure 4B:
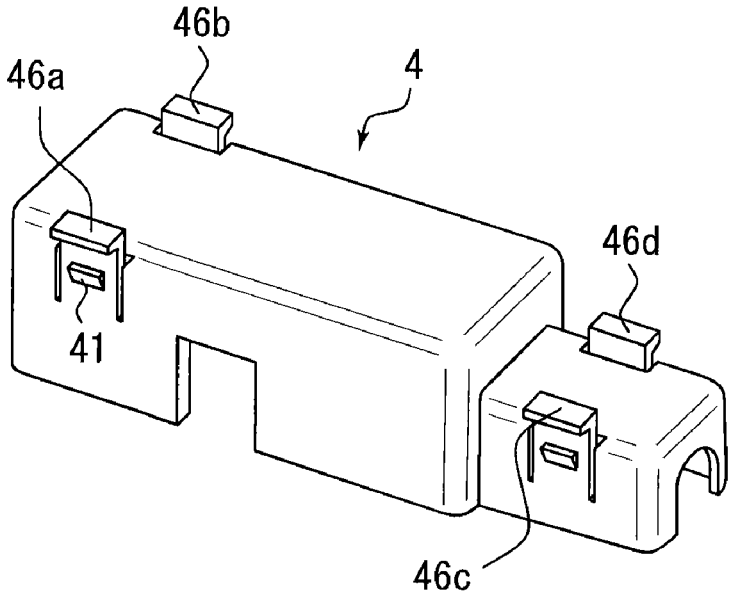
Figure 5:
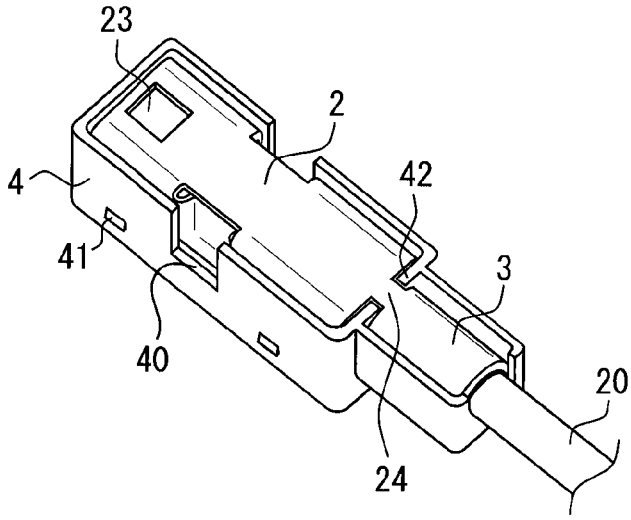
FIG. 5 is a perspective view showing a state where the ground member and a cable clamping portion of the circuit board built-in connector according to the present invention are housed in the insulating cover, as viewed from the back surface side.
Figure 6:
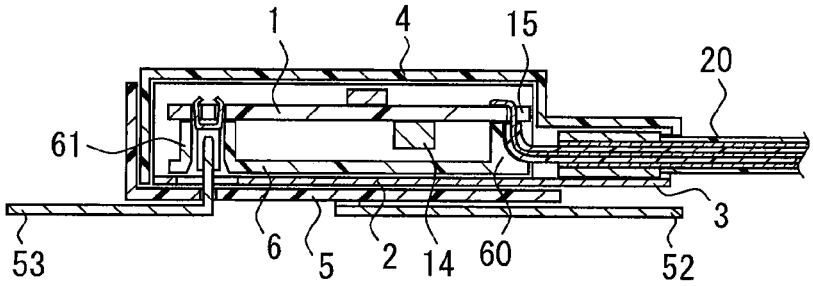
FIG. 6 is a longitudinal cross-sectional view for explaining a configuration of a second embodiment of the circuit board built-in connector and the catcher according to the present invention.
Figure 7:
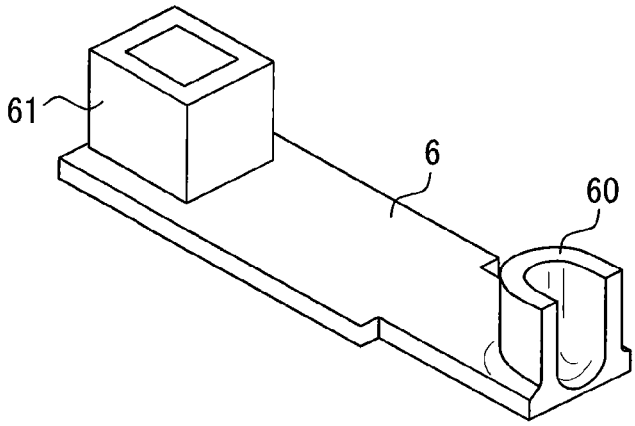
FIG. 7 is a perspective view showing an insulating spacer used in the second embodiment of the circuit board built-in connector according to the present invention.
Figure 8:
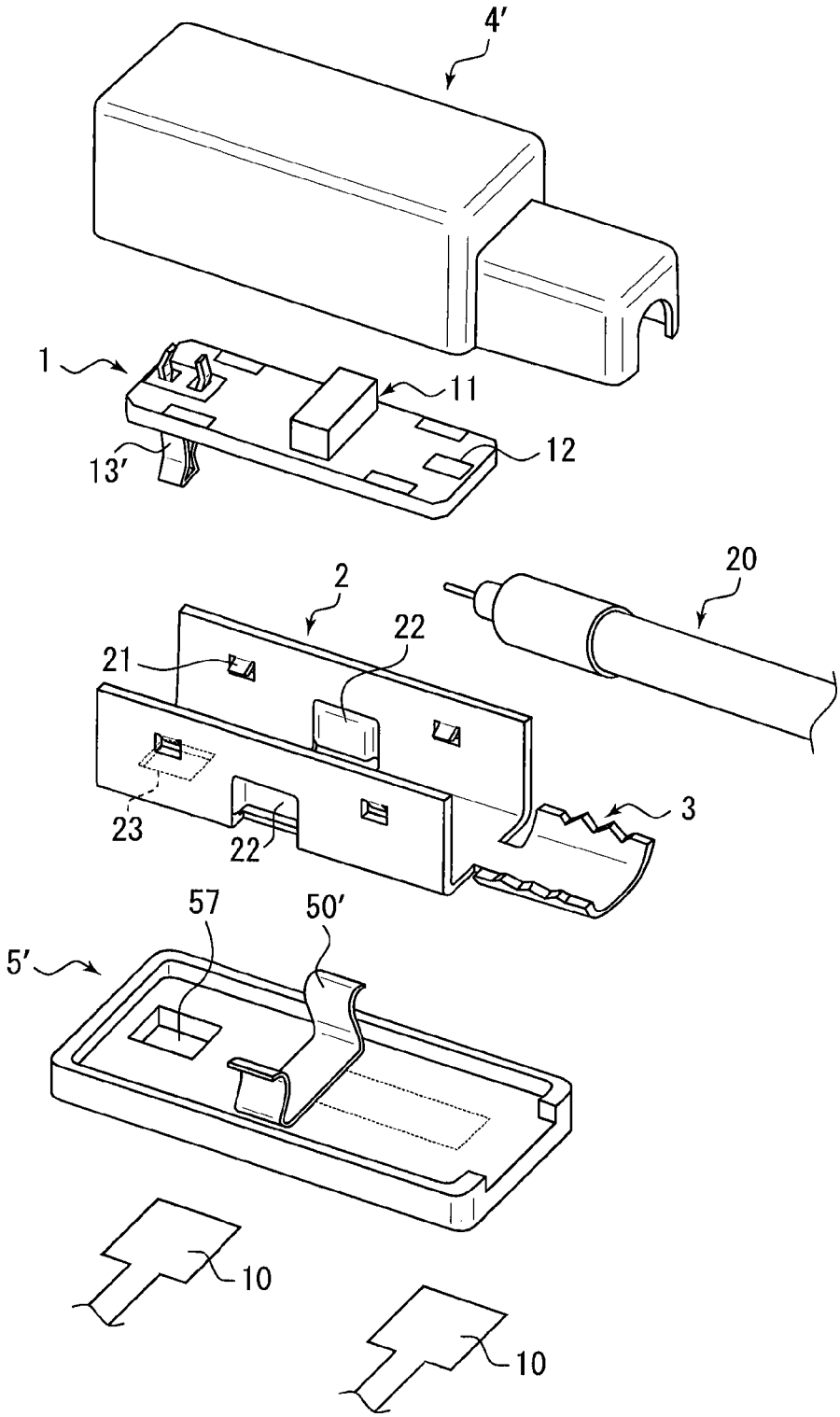
FIG. 8 is an exploded perspective view for explaining a configuration of a third embodiment of the circuit board built-in connector and the catcher according to the present invention.
Figure 9:
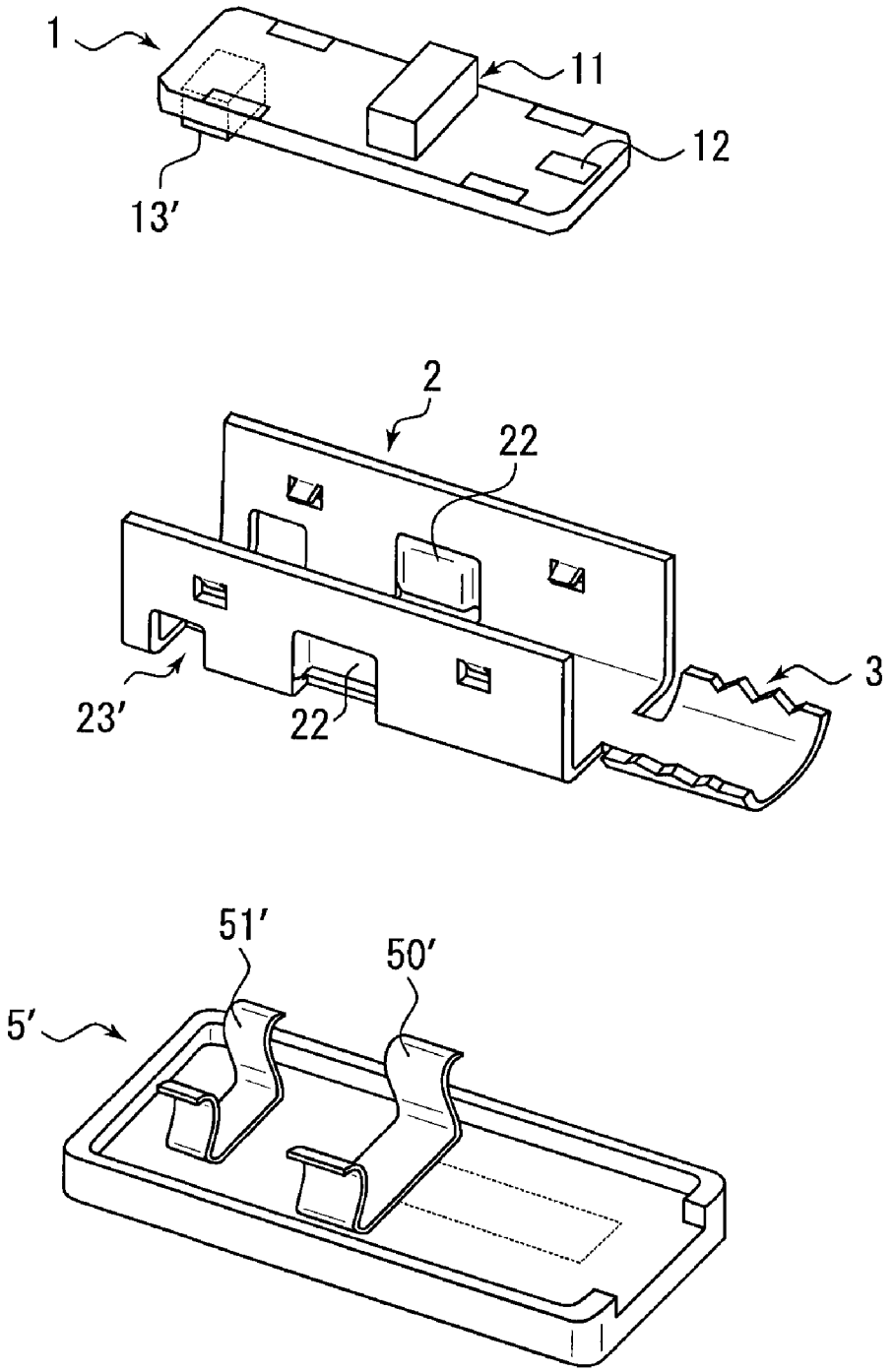
FIG. 9 is a partly exploded perspective view for explaining another example of a connection terminal in the circuit board built-in connector and the catcher according to the present invention.
Figure 10:
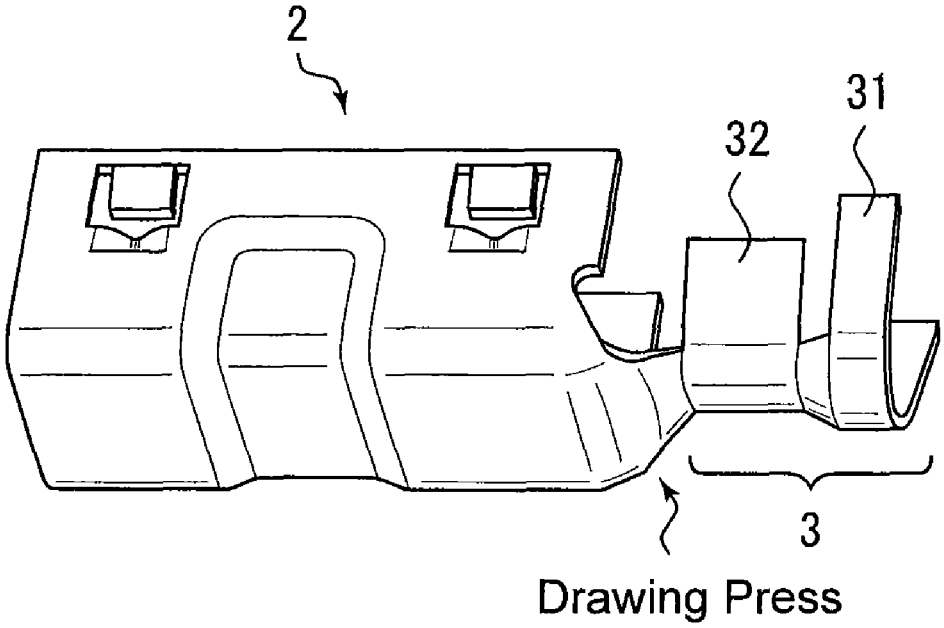
FIG. 10 is a perspective view for explaining a modification of the cable clamping portion of the circuit board built-in connector according to the present invention.

1: Circuit board
2: Ground member
3: Cable clamping portion
4: Insulating cover
5: Catcher
6: Insulating spacer
10: Antenna element
11: Electrical circuit
12: Land of connection terminal
13: Female type connection terminal
14: Tall circuit element
15: Cut portion
18: Surge protection element
20: Cable
21: Fixing claw
22: Concave portion
23: Opening for terminal
24: Constricted portion
31: Cable fixation/clamping portion
32: Electrical connection clamping portion
40: Cut portion
41: Engaging projection
42: Convex portion
45, 46: Knob for removal
50: Ground terminal
51: Power supply terminal
52: Ground side fixed terminal
53: Power supply side fixed terminal
54: Insulating side wall
55: Cut portion
56: Engaging groove
57: Opening
60: Cable-bending guide portion
61: Receiving portion spacer

What is claimed is:

1. A circuit board built-in connector for connecting an antenna element and a cable, said connector comprising:

a circuit board which has a connection terminal connected to a power supply terminal of a catcher and on which an electrical circuit is placed;

a ground member provided adjacent to a side portion of the circuit board in a perpendicular manner to a plate surface of the circuit board and held by a ground terminal of the catcher; and a cable clamping portion extending from the ground member and holding the cable.

2. The circuit board built-in connector according to claim 1, in which the ground member and the cable clamping portion are integrally molded.

3. The circuit board built-in connector according to claim 1, in which the ground member is provided at both longitudinal side portions of the circuit board.

4. The circuit board built-in connector according to claim 1, in which the ground member has a U-shape cross-section as viewed from the narrow side and surrounds the circuit board from at least three directions.

5. The circuit board built-in connector according to claim 1, further comprising an insulating cover for insulating the ground member and the cable clamping portion from outside, the insulating cover having a cut portion at which the ground member is held by the ground terminal of the catcher.

6. The circuit board built-in connector according to claim 1, further comprising a constricted portion positioned between the ground member and the cable clamping portion, and the insulating cover has a convex portion engaged with the constricted portion.

7. The circuit board built-in connector according to claim 1, in which the insulating cover has knobs for removal.

8. The circuit board built-in connector according to claim 1, in which the connection terminal of the circuit board is a surface-mounting connection terminal.

9. The circuit board built-in connector according to claim 1, in which the cable clamping portion includes a cable fixing portion and an electrical connection portion.

10. The circuit board built-in connector according to claim 1, in which a portion between the ground member and the cable clamping portion is formed to have a curved surface through a drawing process.

11. The circuit board built-in connector according to claim 1, in which the circuit board is formed by resin molding.

12. The circuit board built-in connector according to claim 1, further comprising a surge protecting element which is provided adjacent to the connection terminal of the circuit board, and the ground member being positioned away from the connection terminal of the circuit board to such a degree that the ground member and the connection terminal are not capacity-coupled and extends adjacent to the surge protection element.

13. The circuit board built-in connector according to claim 1, in which the ground member is provided to have a space on a top and/or bottom surface of the circuit board, and has a concave portion provided in the space and engaged with the ground terminal of the catcher.

14. A catcher provided on an antenna element side to which a circuit board built-in connector is fitted, the circuit board built-in connector comprising: a circuit board which has a connection terminal and on which an electrical circuit placed; a ground member provided adjacent to a side portion of the circuit board in a perpendicular manner to a plate surface of the circuit board; and a cable clamping portion extending from the ground member and holding the cable, said catcher comprising:

a ground terminal for connecting the ground member and a ground on the antenna element side and holding the ground member; and a power supply element for connecting the connection terminal of the circuit board and the antenna element.

15. The catcher according to claim 14, further comprising an insulating side wall for insulating a connection portion between the ground member and the ground terminal from outside.

16. The catcher according to claim 14, further comprising an insulating cover for insulating the ground member and the cable clamping portion from outside.

* * * * *